United States Patent [19]

Wolf

[11] 3,930,633

[45] Jan. 6, 1976

[54] FORMWORK AND CONNECTING MEANS FOR FORMING ANNULAR STRUCTURES

[75] Inventor: Johann Wolf, Scharnstein, Austria

[73] Assignee: FA. Johann Wolf Gesellschaft m.b.H. KG., Scharnstein, Austria

[22] Filed: Feb. 21, 1974

[21] Appl. No.: 444,389

[30] Foreign Application Priority Data

Mar. 15, 1973 Austria ..... 2314/73

[52] U.S. Cl. ..... 249/1; 249/165; 249/192

[51] Int. Cl.[2] ..... E04G 11/04

[58] Field of Search ..... 425/63–65; 249/1, 17, 20, 192–196, 219 R, 165; 285/421, 365, 471; 24/268, 263

[56] References Cited

UNITED STATES PATENTS

| | | | |
|---|---|---|---|
| 908,326 | 12/1908 | Polk | 425/64 |
| 1,212,397 | 1/1917 | Pierson | 249/1 |
| 1,236,824 | 8/1917 | Davis | 249/192 |
| 1,535,023 | 4/1925 | Kelley | 249/1 |
| 1,641,927 | 9/1927 | Gremel | 249/192 |
| 2,102,717 | 12/1937 | Jennings | 249/219 R |
| 2,151,210 | 3/1939 | Jennings | 249/192 |
| 3,045,313 | 7/1962 | Dorn | 249/17 |
| 3,619,431 | 11/1971 | Weaver et al. | 425/64 |
| 3,733,163 | 5/1973 | Hermann | 425/262 |

FOREIGN PATENTS OR APPLICATIONS

| | | | |
|---|---|---|---|
| 482,970 | 1/1970 | Switzerland | 24/268 |

*Primary Examiner*—Robert D. Baldwin
*Assistant Examiner*—John McQuade
*Attorney, Agent, or Firm*—Young & Thompson

[57] ABSTRACT

A plurality of formwork elements are provided, each of which is curved according to an arc of a circle and which are assembled to form an inner formwork wall and an outer formwork wall. Each of said formwork elements have two vertical edges provided with angled portions which form engaging faces, which engage engaging faces of horizontally adjacent formwork elements of the same formwork wall. Said angled portions of said formwork elements of said outer formwork wall extend outwardly. Said angled portions of said formwork elements of said inner formwork wall extend inwardly.

13 Claims, 7 Drawing Figures

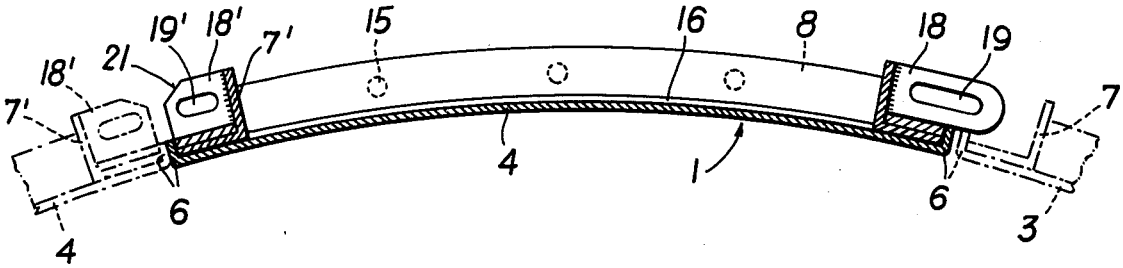

FORMWORK AND CONNECTING MEANS FOR FORMING ANNULAR STRUCTURES

Known formwork for use in making round tanks consists of individual panels, which are curved on a certain radius and are assembled in that the stiffening bars are connected by screws. In some types, pins having a head and provided with a cotter are used rather than screws. In the known types, the inner and outer walls of the formwork are spaced apart by spacers and held together by elements extending through the walls, such as bolts, cottered pins, wires or the like. The outer wall of formwork for use in making a large tank is additionally reinforced by vertically spaced apart strips or chains or the like, which are applied around the periphery. The inner formwork wall is often supported against a central post by spaced apart, radial struts.

The bars or stiffening ribs provided at the periphery are so wide that they can receive the elements for connecting the several panels, such as bolts extending through the walls, or cotterable pins. This mounting of the connecting elements has the disadvantage that the connecting elements are substantially spaced apart from the actual formwork wall. When high pressures occur in the construction of large containers, particularly where powerful vibrators are employed, the joints between adjacent panels may be deformed and partly pulled open so that the cast tanks have uneven surfaces and considerable straightening work is required before these formwork elements can be used again. If the confining bars of the panels are very strong so that they oppose such damage, a large amount of material will be required and the formwork can be erected only with difficulty because the panels are unhandy.

Another serious disadvantage of these known formwork elements resides in that they can be adapted to different radii only to a restricted extent because they have wide frames and substantial deviations would result in V-shaped joints on the inside or outside of the bars.

In conclusion it can be stated that the known formwork elements cannot be adequately adapted to different diameters, much time is required to interconnect the elements, and the cast tank has a large number of apertures which are due to the spacers. By time-consuming manual work, these holes must subsequently be closed with concrete and often give rise to leaks.

It is an object of the invention to eliminate these disadvantages and to provide a formwork which is intended to be used in making round tanks and which is simple in structure and enables a simple erection of round tanks which differ in diameter and which have smooth outside and inside surfaces which need not be subsequently finished.

A formwork for use in making round tanks comprises inner and outer formwork walls consisting of formwork elements curved according to an arc of a circle and made preferably of sheet metal and the essential feature of such formwork resides according to the invention in that each formwork element is provided with short angled portions, which form engaging faces and which on the outside formwork wall extend outwardly and on the inner formwork wall extend inwardly. These engaging faces of the formwork elements afford the advantage that the formwork elements can be adjusted relative to each other by relatively large angles to vary the diameter and that such adjustments do not give rise to gaps which result in a formation of ribs on the outside and inside surfaces of the round tank.

It is another object of the invention to enable a change in diameter by metric increments. For this purpose the width of the formwork elements forming the inner formwork wall, measured in the circumferential direction from engaging edge to engaging edge, is $n\pi$ centimeters, where $n$ equals, e.g., 25 or a multiple of 25. In that case the insertion or removal of one formwork element will result in a change in diameter by $\pm$ 25 centimeters.

It is also a feature of the invention that the dimension of the angled portion in a radial direction with respect to the center of curvature of the formwork elements is about two to four times the wall thickness of the formwork elements. Where the angled portions have these dimensions, a change of the angular positions of the several formwork elements relative to each other will not give rise to gaps.

Another feature of the invention resides in that angle section members are secured to the two vertical edges of each formwork element and have flanges which extend in the circumferential direction and engage the inside surface of the angled portions whereas the other flanges of the angle section members extend outwardly on the outer formwork wall and inwardly on the inner formwork wall. To stiffen the formwork elements, horizontal stiffening bars may be secured to the upper and lower edges thereof and superimposed formwork elements are adapted to be clamped together by clamping means which engage the stiffening bars. The stiffening bars of superimposed formwork elements are provided with aligned bores and the clamping means have a pin, which is adapted to be inserted into said bores and provided on an angled portion of a tightening plate, which has an angled slot having a portion that is at right angles to the pin and defined by an oblique surface. Where such formwork elements and clamping means are used, the formwork elements can be reliably interconnected in a vertical direction and that connection can be established in a rapid and simple manner.

To connect the formwork elements of the outer formwork wall in the peripheral direction, the formwork elements are provided with lugs which have slots extending in the circumferential direction and adapted to receive tightening wedges. These lugs extend beyond the engaging faces and bear on the edges of the angled portions of adjacent formwork elements. In one embodiment of the invention a pair of lugs and a lug extending between a pair of lugs are arranged in alternation and spaced preferably in a vertical direction. According to the invention the slots in the lugs are rounded at their ends engaging the tightening wedges, the effective wedge surfaces of the tightening wedges are rounded too, and the width of the slots exceeds the thickness of the tightening wedges.

With the aid of the lugs and tightening wedges provided according to the invention, the several formwork elements can be reliably urged against each other in the circumferential direction by a strong force so that reliable seals are provided at the engaging faces and the formwork elements can take up the considerable pressure which is exerted as the concrete is placed.

To enable a removal of the outer formwork wall when the concrete has been placed, so-called opening-forming elements are provided, the essential feature of which resides in that angle section members having flanges of different width are provided, the wider flanges of said angle section members are secured to the mutually engaging faces of preferably two adjacent formwork elements, lugs which are aligned with the angle section members are inserted into said wide flanges and have slots, and loose clamping plates having slots are provided to establish the connection by means of tightening wedges. Because the lugs are aligned with the angle section members, the two adjacent formwork elements can be pivotally moved outwardly and can then be pulled parallel to themselves from the other formwork elements. When adjacent panels of the round tank have been exposed, the remaining formwork elements can be pulled off in the peripheral direction.

It is also a feature of the invention that the formwork elements forming the inner formwork wall are supported against vertical posts, which are arranged on a circle preferably in such a manner that a post is approximately centrally disposed within each odd-numbered formwork element and adjacent posts are interconnected by struts which are adjustable in length. According to the invention the formwork elements may be supported against the posts by horizontal struts, which extend to those engaging faces of the formwork element which are opposite to the posts and which contact the adjacent formwork elements, and struts which are adjustable in length and which extend to those engaging faces of the adjacent formwork elements which contact the next following formwork elements. In this case, three formwork elements can be supported on each post and a double support of formwork elements against adjacent posts is provided by the use of crossing struts which are adjustable in length. In addition, the superimposed formwork elements which are disposed opposite to the posts may be supported by crossing inclined struts which lie in a radial plane.

If the inner formwork wall is supported according to the invention against vertical posts, which may be composed of sections connected by detachable connections, the inner formwork wall can reliably take up the high pressures exerted as the concrete is placed and the inner formwork wall can easily be taken apart when the concrete has been placed. For this reason, the struts are detachably connected to the posts and to the formwork elements, preferably to the vertical angle section members at the edges of the formwork elements and the horizontal angle section stiffening members of the formwork elements.

Details of the invention will now be explained more fully with reference to the accompanying drawings, which show diagrammatically and by way of example A formwork for making a round tank of concrete.

Figure 2:
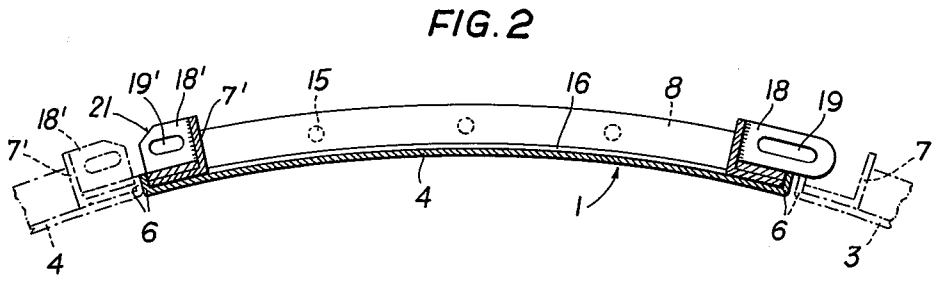
FIG. 2 is an enlarged top plan view showing a single formwork element.
Figure 3:
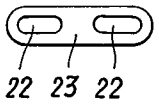
FIG. 3 is a detail view showing a joint between adjacent formwork elements.
Figure 1:
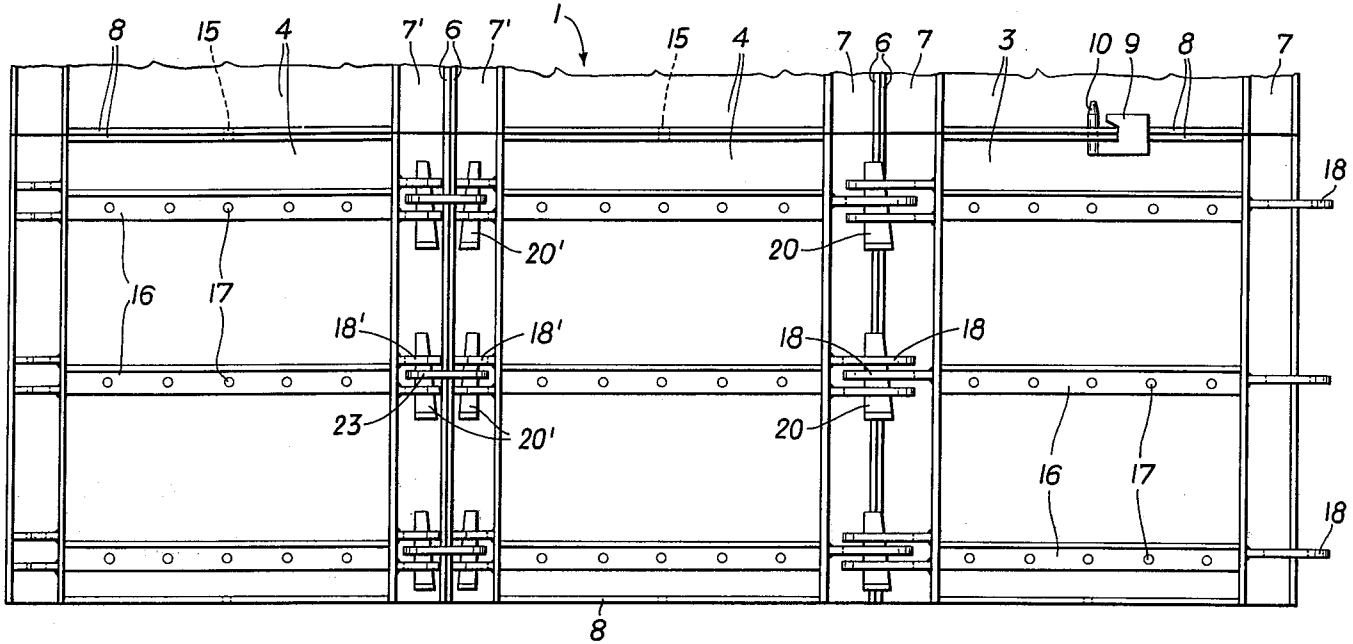
FIG. 1 is an outside elevation showing three adjacent formwork elements of an outer formwork wall.

The formwork according to the invention comprises an outer formwork wall 1 and an inner formwork wall

2. These walls 1 and 2 are composed of individual formwork elements 3, 4, and 5. The formwork elements 3 form the outer formwork wall 1. Adjacent formwork elements 4 constitute opening-forming elements. The formwork elements 3, 4, and 5 are curved according to an arc of a circle and are provided on their two vertical edges with short angled portions 6, which form engaging faces between adjacent formwork elements.

The width of the formwork elements 5 forming the inner formwork wall, measured from engaging edge to engaging edge, amounts to $n\,\pi$ centimeters, e.g., $25\,\pi$ centimeters = 78.5 centimeters. In that case, the diameter will be increased by 25 centimeters if a formwork element 5 is inserted into the inner formwork wall, and the diameter will be decreased by 25 centimeters if a formwork element 5 is removed. The angled portions 6 form engaging faces which have a radial dimension that is about two to four times the wall thickness of the formwork elements. When the angular relation between the form-work elements is changed by the insertion or removal of a formwork element, these engaging faces formed by the angled portions 6 prevent a formation of gaps. Particularly in the making of large round tanks, for which the formwork according to the invention is particularly intended, the change of the angular relation is so small that the outside and inside surfaces of the round tank depart only very slightly from the form of a geometric cylinder.

Each formwork element 3, 4 or 5 is stiffened at both vertical edges by angle section members 7, which are secured to the outside of the formwork elements 3 and 4 forming the outer formwork wall and to the inside of the formwork elements 5 forming the inner formwork wall. The fixation is effected in such a manner that the flange which contacts the formwork element engages the inside surface of the angled portions 6 and the other flange extends outwardly on the outer formwork wall and inwardly on the inner formwork wall. In this way the angled portions 6 are properly supported on the angle section members 7.

Figure 4:
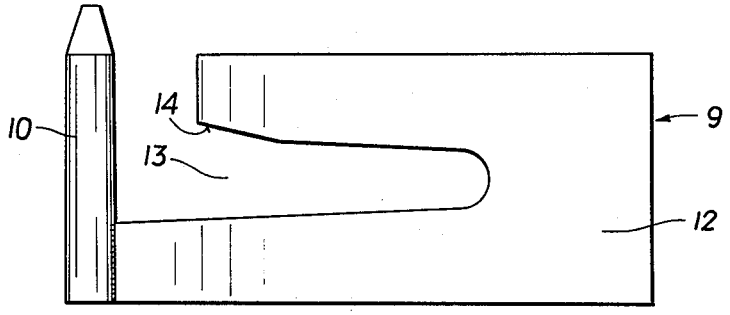
FIG. 4 is an enlarged detail top plan view showing a joint between superimposed formwork elements.
Figure 5:
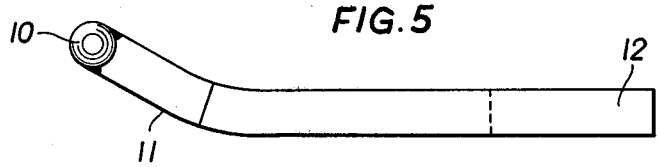
FIG. 5 is an enlarged detail side elevation showing a joint between superimposed formwork elements.

The formwork elements 3, 4, and 5 are further stiffened by stiffening bars 8, which are secured to the upper and lower edges of each formwork element and on which superimposed formwork elements are supported. Clamping means 9 are provided to connect superimposed formwork elements 3, 4, and 5. According to FIGS. 4 and 5 these clamping means comprise a pin 10 provided on an angled portion 11 of a tightening plate 12. The tightening plate has an angled slot 13, which has a portion that extends at right angles to the pin 10 and is defined by an oblique surface 14. The stiffening bars 8 are provided with bores 15 for receiving the pin 10. When the pin 10 has been introduced into the aligned bores of superimposed stiffening bars, the formwork elements are held against displacement. When the tightening plate 12 has been pivotally moved, the slot 13 is pushed over the stiffening bars 8 so that the same are tightly pressed against each other.

The formwork elements may be stiffened on the outside and inside by angle section stiffening members 16, which have flanges that engage the formwork elements and are provided with holes 17 for receiving spot welds.

To enable a connection between the formwork elements 3 of the outer formwork walls, the same are provided with lugs 18, which are inserted into and joined to the angle section members 7 and have peripherally extending slots 19 having rounded ends. These lugs engage the angled portions 6 and extend in the circumferential direction toward the adjacent formwork element beyond the engaging faces formed by the angled portions of the formwork elements. Pairs of such lugs are suitably spaced apart in the direction of the height of each formwork element in alternation with single lugs, which extend between the lugs of respective pairs of an adjacent formwork element. As a result, the slots 19 are partly in register and receive tightening wedges 20 so that the formwork elements are tightly forced against each other at their angled portions 6 and are joined in the circumferential direction. The width of the slots 19 suitably exceeds the thickness of the tightening wedges 20, and the latter as well as the slots 19 are rounded at their mutually engaging edges. As a result, the engaging faces are forced against each other with great force and tightly even when the angular relation of adjacent formwork elements has been changed.

To enable a removal of the outer formwork wall 1 when the concrete has been placed, opening-forming elements 4 are provided, which have angle section members 7' having different flanges and secured to the vertical faces of the formwork elements. These angle section members 7' receive lugs 18', which are aligned with the angle section members 7' and have slots 19'. These lugs 18' may have beveled edges, as is indicated at 21. For a connection between adjacent opening elements, tightening plates 23 are provided, which have slots 22, which can be caused to register with the slots 19' and receive tightening wedges 20'. When the tightening wedges 20' have been loosened and the tightening plates 22 have been removed, one of the formwork elements 4 (opening-forming element) can be pivotally moved and can then be pulled off parallel to itself. This is facilitated by the beveled surface 21. The other formwork element 4 can now be removed too and the remaining formwork elements 3 can also be removed without obstruction when the clamping means 9 and the tightening wedges have been loosened.

Figure 7:
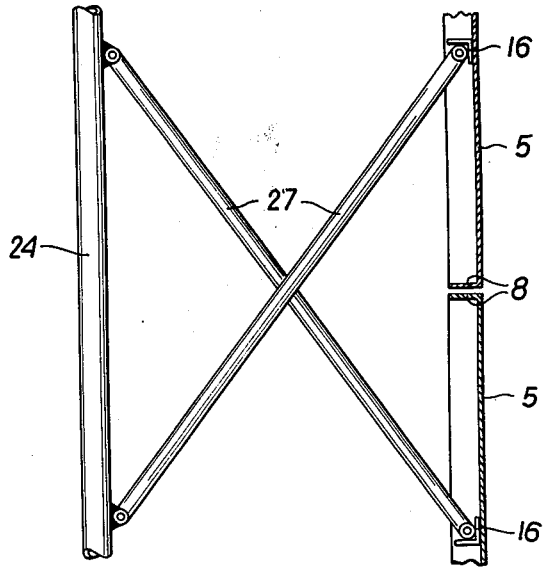
FIG. 6 is a top plan view showing an inner formwork wall and FIG. 7 is a sectional view taken on line A–B of FIG. 6.
Figure 6:
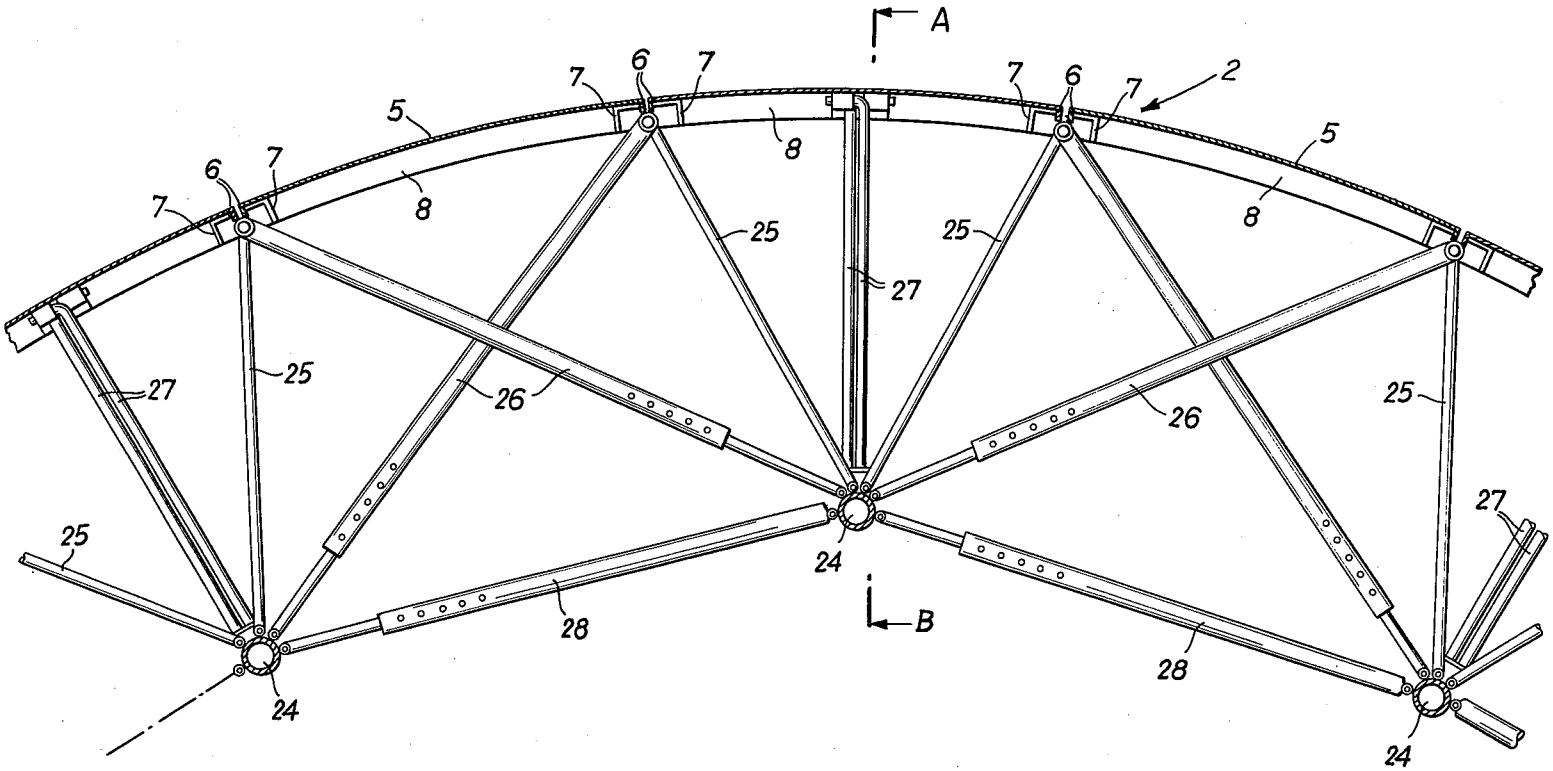

The formwork elements 5 forming the inner formwork wall 2 are supported against vertical posts 24, which are arranged on a circle and preferably inwardly of respective odd-numbered formwork elements 5. These posts 24 are interconnected by struts 28, which are adjustable in length. The formwork elements 5 are supported against the posts 24 by horizontal struts 25, which extend to the engaging faces of the formwork element 5 which is opposite to the post 24 and which are suitably detachably connected there to the angle section members 7. Additional horizontal struts 26 which are variable in length extend to the remote engaging faces of the adjacent formwork elements 5 and are also detachably connected to the angle section members 7. The struts 25 and 26 are also detachably connected to the posts 24 to facilitate the removal of the inner formwork wall. As is apparent from FIGS. 4 and 5, those of the struts 26 variable in length which extend from adjacent posts 24 cross each other so that an additional support is provided. In addition, the formwork elements 5 which are opposite to the posts 24 may be supported against the posts 24 by crossing struts 27, which are detachably connected to the angle section stiffening members 16 of superimposed formwork elements 5, as is shown in FIG. 7. These struts lie in a radial plane and are inclined from the vertical.

An embodiment of the formwork according to the invention for use in making round tanks has been described hereinbefore and is shown on the drawing to enable an explanation of the invention although the latter is not restricted to details.

I claim:

1. Formwork for use in making a round tank, which comprises a plurality of formwork elements each of which is curved according to an arc of a circle and which are assembled to form an inner formwork wall and an outer formwork wall, each of said formwork elements having two vertical edges provided with angled portions which form engaging faces, which engage engaging faces of horizontally adjacent formwork elements of the same formwork wall, said angled portions of said formwork elements of said outer formwork wall extending outwardly, said angled portions of said formwork elements of said inner formwork wall extending inwardly, said formwork elements forming said outer formwork wall being provided with lugs formed with circumferentially extending slots, the slots of adjacent formwork elements overlying each other, tightening wedges inserted in said slots to hold said adjacent formwork elements together, said lugs extending beyond and bearing against the outer edges of said angled portions, and angle section members secured to said two vertical edges of each of said formwork elements and having first flanges extending in the circumferential direction and engaging the inside of said angled portions, and second flanges, said second flanges of said angle section members of the outer formwork wall extending outwardly and said second flanges of said angle section members of the inner formwork wall extending inwardly, said lugs being secured to said angle section members of the outer formwork wall.

2. Formwork as set forth in claim 1, in which said formwork elements consist of sheet metal.

3. Formwork as set forth in claim 1, in which said angled portions have in the radial dimension with respect to the center of curvature of the associated formwork element a dimension which is approximately two to four times the wall thickness of the formwork element.

4. Formwork as set forth in claim 1, which comprises a circular series of vertical posts supporting the formwork elements forming said inner formwork wall.

5. Formwork as set forth in claim 4 in which one of said posts is disposed inwardly and approximately midway of each odd-numbered formwork element of said inner formwork wall and adjacent posts are connected by struts which are adjustable in length.

6. Formwork as set forth in claim 5, in which said struts are detachably connected to said posts.

7. Formwork as set forth in claim 4, in which said formwork elements of said inner formwork wall are connected to said posts by first and second struts, said first struts are horizontal and extend to those engaging faces of the formwork element which is opposite to respective posts which engage horizontally adjacent formwork elements of said inner formwork wall, and said second struts are adjustable in length and extend to those engaging edges of said horizontally adjacent formwork elements which engage the next following formwork elements of said inner formwork wall.

8. Formwork as set forth in claim 4, in which said formwork elements which are opposite to said posts and formwork elements of said inner formwork wall which are superimposed on said opposite formwork elements are supported by crossing inclined struts disposed in a radial plane.

9. Formwork as set forth in claim 4, which comprises struts detachably connected to said posts and to formwork elements of said inner formwork wall.

10. Formwork as set forth in claim 9, in which angle section members are secured to said two vertical edges of each of said formwork elements of said inner formwork wall and have flanges extending in the circumferential direction and engaging the inside of said angled portions of said formwork elements of said inner formwork wall, and second flanges, said second flanges extend inwardly, angle section stiffening members are provided which are disposed on the inside of said formwork elements of said inner formwork wall and have flanges which engage the formwork elements adjacent thereto and are formed with holes which contain spot welds, and said struts are detachably connected to said angle section members and said angle section stiffening members.

11. Formwork as set forth in claim 4, in which each of said posts consists of sections connected by detachable connections.

12. Formwork for use in making a round tank, which comprises a plurality of formwork elements each of which is curved according to an arc of a circle and which are assembled to form an inner formwork wall and an outer formwork wall, each of said formwork elements having two vertical edges provided with angled portions which form engaging faces, which engage engaging faces of horizontally adjacent formwork elements of the same formwork wall, said angled portions of said formwork elements of said outer formwork wall extending outwardly, said angled portions of said formwork elements of said inner formwork wall extending inwardly, means holding said formwork elements forming said outer formwork wall together, each of said formwork elements comprising, 1 an upper edge and a lower edge, each of said formwork walls comprising superposed formwork elements, horizontal stiffening bars secured to said upper and lower edges, and clamping means which engage said horizontal stiffening bars at adjacent edges of superimposed formwork elements to hold them together, said horizontal stiffening bars at adjacent edges of superimposed formwork elements being formed with aligned bores, said clamping means comprising a tightening plate having an angled portion provided with a pin extending into said bores, said tightening plate having an angled slot therein having a portion which is at right angles to said pin and that is defined by surfaces of said tightening plate that converge in a direction away from said pin, said pin being disposed at one end of said slot and said slot being closed at its other end but opening through a side edge of said tightening plate beside said pin.

13. Formwork for use in making a round tank, which comprises a plurality of formwork elements each of which is curved according to an arc of a circle and which are assembled to form an inner formwork wall and an outer formwork wall, each of said formwork elements having two vertical edges provided with angled portions which form engaging faces, which engage engaging faces of horizontally adjacent formwork elements of the same formwork wall, said angled portions of said formwork elements of said outer formwork wall extending outwardly, said angled portions of said formwork elements of said inner formwork wall extending inwardly, angle section members having flanges at right angles to each other, one of said flanges being secured to one of said formwork elements at an edge thereof which is adjacent to another formwork element, lugs that are secured to the other of said flanges and that have circumferentially extending slots therein, separate tightening plates formed with circumferentially extending slots therein, the slots of each tightening plate overlying said slots of said lugs of both of an adjacent pair of formwork elements, and tightening wedges inserted in said slots thereby to interconnect and hold together said adjacent formwork elements via said separate tightening plates.

* * * * *